US006167670B1

(12) United States Patent
Reite et al.

(10) Patent No.: US 6,167,670 B1
(45) Date of Patent: Jan. 2, 2001

(54) CASING SYSTEM FOR DUMBWAITERS

(76) Inventors: John Reite; John David Reite, both of 3990 Blackberry La., P.O. Box 4390, Georgetown, CA (US) 95634

( * ) Notice: Under 35 U.S.C. 154(b), the term of this patent shall be extended for 0 days.

(21) Appl. No.: 09/283,043

(22) Filed: Apr. 1, 1999

(51) Int. Cl.[7] ..... E04H 12/08

(52) U.S. Cl. ..... 52/637; 52/585.1; 52/586.1; 52/651.07; 187/401; 187/242; 187/414; 414/594

(58) Field of Search ..... 52/582.1, 585.1, 52/586.1, 586.2, 637, 563.1, 561.07, 592.2, 284, 476; 187/401, 407, 242, 249, 270, 414; 414/608, 673, 594

(56) References Cited

U.S. PATENT DOCUMENTS 5,980,160 * 11/1999 Vanderklaauw ..... 405/230
6,047,509 * 4/2000 Savoic ..... 52/281

* cited by examiner

*Primary Examiner*—Carl D. Friedman
*Assistant Examiner*—Yvonne M. Horton
(74) *Attorney, Agent, or Firm*—J. Sanchelima

(57) ABSTRACT

A system for building shaft casing for dumb-waiters in a building structure with prefabricated assemblies that are readily stackable over each other. One lower, middle and top assemblies constitute the minimum combination typically used in going from one floor to the next. However, the middle and upper assemblies can be repeated depending on the structure where the system is installed. The assemblies include each four elongated corner members with respective ends that receive connecting pin members that permit the structurally stable stacking up of the assemblies. A central and continuous passage is defined. The lower assembly includes two apertures with adjacent compartments within the central passage one to have access to the dumbwaiter and the other one to access the motor and control means. The top assembly has an aperture to provide access to the sprocket mechanism used with the chain that suspends the dumbwaiter within the shaft casing. The components in all assemblies are similar, contributing to the simplification of the inventory logistics.

3 Claims, 2 Drawing Sheets

CASING SYSTEM FOR DUMBWAITERS

BACKGROUND OF THE INVENTION

1. Field of the Invention

The present invention relates to a casing system for dumbwaiters and more particularly to the type that is prefabricated and ready for on site assembly.

2. Description of the Related Art

Many dumbwaiter mechanisms have been designed in the past. Typically, these mechanisms require the construction of a shaft with a casing that extends from floor to floor. Due to fire hazard concerns, different jurisdictions require the shaft's casing to provide walls with fire retarding characteristics, typically, no less than 1.5 hours. These nonuniform regulations, along with lack of familiarity with this otherwise useful and time saving apparatus, have limited their use in new buildings and/or made it very expensive to implement. The present invention provides a ready made, stackable casing system that can be adapted to most structural situations.

None of the dumbwaiter systems known to the applicant provide for this novel approach for the installation of a shaft casing. Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a system of stackable shaft casing assemblies to form a continuous vertical passage through which a dumbwaiter is raised and lowered, and these assemblies can be adapted to practically any dimensions within a reasonable range.

It is another object of this invention to provide a system of stackable shaft casing assemblies that can be readily assembled on site.

It is yet another object of this invention to provide a system of such stackable shaft casing assemblies that is volumetrically efficient for transportation and storage and since it comprises mostly standard components, the inventory logistics are greatly reduced.

Further objects of the invention will be brought out in the following part of the specification, wherein detailed description is for the purpose of fully disclosing the invention without placing limitations thereon.

DETAILED DESCRIPTION OF THE PREFERRED EMBODIMENT

Figure 1:
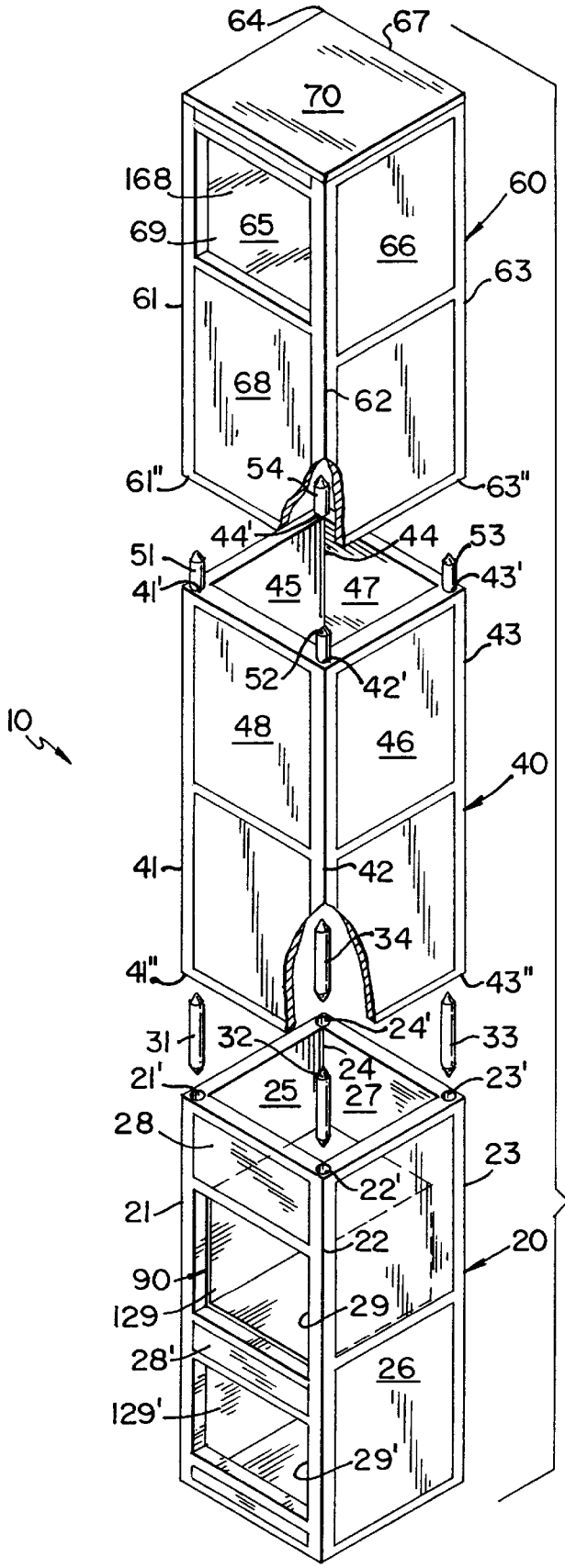
FIG. 1 is an isometric view of one of the preferred embodiment showing three stackable assemblies of a shaft casing, typically connecting two floors in a building structure.

Referring now to the drawings, where the present invention is referred to with numeral 10, it can be seen that the basic system (for two floors) includes bottom assembly 20, middle assembly 40 and upper assembly 60 that are stackable continuously one next to the other one. An elongated through passage is defined therein through each of the assemblies for housing a dumbwaiter that is transported vertically by a chain and motor means.

Figure 2:
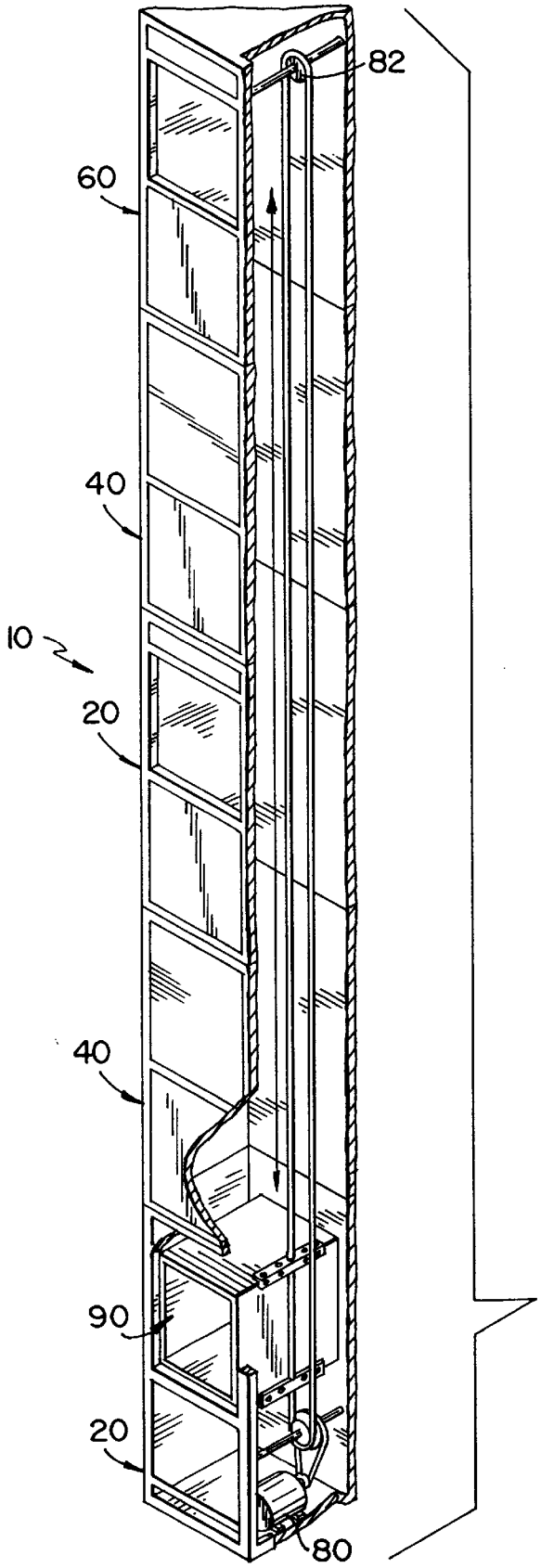
FIG. 2 is an isometric view of the invention including the chain loop, carrier and motor assemblies.

Lower assembly 20 includes four structural elongated corner post members 21; 22; 23 and 24 that are disposed in a parallel relationship with respect to each other defining a rectangular projection. The upper ends of post members 21; 22; 23 and 24 include respective openings 21'; 22'; 23' and 24' that receive and house one half of pins 31; 32; 33 and 34. Lateral walls 25 and 26 extend parallel to each other and back wall 27 extends perpendicularly with respect to walls 25 and 26 and joining them. The front of assembly 20 includes upper front wall 28 and central wall 28', being separated a predetermined distance defining upper aperture 29 and lower aperture 29'. Compartment 129 defines a space adjacent to aperture 29 that provides access to the dumbwaiter carrier 90 housed within shaft casing 10. Compartment 129' defines a space at the lower end of system 10 adjacent to aperture 29' for housing the motor and control means 80, as shown in FIG. 2.

Middle assembly 40 includes four structural elongated corner post members 41; 42; 43 and 44 that are disposed in a parallel relationship with respect to each other defining a rectangular projection. The lower ends of post members 41; 42; 43 and 44 include openings 41"; 42"; 43"and 44" that receive and house one half of pins 31; 32; 33 and 34. Middle assembly 40 is positioned over assembly 20. The upper ends of post members 41; 42; 43 and 44 include respective openings 41'; 42'; 43'and 44' that receive and house one half of pins 51; 52; 53 and 54. Lateral walls 45 and 46, back wall 47 and front wall 48 extend perpendicularly with respect to each other defining an internal passage that connects with the internal passage defined by assembly 20.

Upper assembly 60 also includes four structural elongated corner post members 61; 62; 63 and 64 that are disposed in a parallel relationship with respect to each other defining a rectangular projection. The lower ends of post members 61; 62; 63 and 64 include openings 61"; 62"; 63" and 64" that receive and house one half of pins 51; 52; 53 and 54, as upper assembly 60 is positioned over assembly 40. Lateral walls 65 and 66 and back wall 67 and front wall 68 extend perpendicularly with respect to each other defining an internal passage that connects with the internal passage defined by assembly 60. Front wall 68 includes aperture 69 at uppermost end and it is adjacent to compartment 168 that permit access to the sprocket means 82 mounted on the internal surface of top wall 70 at the end of shaft casing 10.

Depending on the structure where shaft casing 10 is going to be installed, the number of middle assemblies 40 may be varied depending on the number of floors to be serviced. Also, inbetween floors will require the use of one additional assembly 60 per floor to permit access to the dumbwaiter carrier 90 in the internal passage defined by shaft casing 10.

The walls in system 10 described here are made out of fire retarding material that also suppress the noise generated by the traveling dumbwaiter. This material can be a polystyrene. Doors or closures should be constructed of similar materials. In many instances, the outer walls of casing 10 are surrounded by a Sheetrock walls to further insulate casing 10.

It has been found that assembly of casing 10 takes only a few minutes per floor with maximum flexibility in its configuration. Also, the inventory logistics are optimized with a minimum of different parts to inventory.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shaft casing for dumbwaiters, comprising:

A) a lower assembly comprising first, second, third and fourth elongated members, each having two ends with openings, positioned at spaced apart and parallel relationship with respect to each other defining a rectangular projection, and including first and second lateral walls mounted to said first, second, third and fourth elongated members and positioned at a spaced apart and parallel relationship with respect to each other, and said lower assembly further including a first back wall perpendicularly mounted to said first and second lateral walls, and said lower assembly further including a first front wall having first and second apertures so that a first central passage is defined with first and second compartments adjacent to said first and second apertures and within said internal passage;

B) a middle assembly comprising fifth, sixth, seventh and eighth elongated members, each having two ends, positioned at spaced apart and parallel relationship with respect to each other defining a rectangular projection, and including third and fourth lateral walls mounted to said fifth, sixth, seventh and eighth elongated members and positioned at a spaced apart and parallel relationship with respect to each other, and said middle assembly further including a second back wall and a second front wall perpendicularly mounted to said third and fourth lateral walls so that a second central passage is defined;

C) first, second, third and fourth pin members partially housed within one of the openings on the ends of said first, second, third and fourth elongated tubular members and the remaining portion of said first, second, third and fourth pin members being housed within one of the ends of said fifth, sixth, seventh and eighth elongated tubular members so that said lower and middle assemblies are kept in coaxial alignment with respect to each other;

D) a top assembly comprising ninth, tenth, eleventh and twelfth elongated tubular members, each having two ends with openings, positioned at a spaced apart and parallel relationship with respect to each other defining a rectangular projection, and including fifth and sixth lateral walls mounted to said ninth, tenth, eleventh and twelfth elongated tubular members and positioned at a spaced apart and parallel relationship with respect to each other, and said top assembly further including a third back wall and a third front wall perpendicularly mounted to said fifth and sixth lateral walls, said third front wall includes a third aperture, and further including a top wall perpendicular to said so that a third central passage is defined with a third compartment adjacent to said third aperture; and E) fifth, sixth, seventh and eighth pin members partially housed within one of the openings on the other ends of said fifth, sixth, seventh and eighth elongated tubular members and the remaining portion of said fifth, sixth, seventh and eighth pin members being housed within one of the ends of said ninth, tenth, eleventh and twelfth elongated tubular members so that said top and middle assemblies are kept in coaxial alignment with respect to each other and defining a continuous central passage comprising said first, second and third central passages.

2. The shaft casing set forth in claim 1 wherein said lateral, front and back walls are made of a fire retardant material.

3. The shaft casing set forth in claim 2 wherein said lateral, front and back walls are made out of polystyrene.

* * * * *